US008891993B2

(12) United States Patent
Kanari et al.

(10) Patent No.: US 8,891,993 B2
(45) Date of Patent: Nov. 18, 2014

(54) IMAGE FORMING APPARATUS CAPABLE OF REDUCING A TONER CONSUMPTION AMOUNT BY PERFORMING TONER SUPPLY CONTROL

(75) Inventors: Kenji Kanari, Numazu (JP); Shinji Hashiguchi, Mishima (JP); Masato Sako, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 13/454,969

(22) Filed: Apr. 24, 2012

(65) Prior Publication Data

US 2012/0275807 A1 Nov. 1, 2012

(30) Foreign Application Priority Data

Apr. 28, 2011 (JP) ..... 2011-101429

(51) Int. Cl.

| | |
|---|---|
| ***G03G 15/16*** | (2006.01) |
| ***G03G 21/00*** | (2006.01) |
| ***G03G 21/20*** | (2006.01) |
| ***G03G 15/00*** | (2006.01) |

(52) U.S. Cl.

CPC ..... *G03G 15/161* (2013.01); *G03G 2215/1661* (2013.01); *G03G 15/556* (2013.01)

USPC ..... 399/71; 399/44; 399/101

(58) Field of Classification Search

CPC ..... G03G 15/168; G03G 21/0011; G03G 21/0094; G03G 21/20; G03G 2215/1661

USPC ..... 399/44, 71, 101, 346

See application file for complete search history.

(56) References Cited

U.S. PATENT DOCUMENTS

| | | | | |
|---|---|---|---|---|
| 5,881,339 | A * | 3/1999 | Yanagida et al. | 399/101 |
| 6,311,031 | B1 * | 10/2001 | Hirano | 399/101 |
| 7,664,413 | B2 * | 2/2010 | Kobayashi et al. | 399/101 X |
| 2004/0265023 | A1 * | 12/2004 | Yoshida et al. | 399/346 |
| 2011/0222885 | A1 * | 9/2011 | Yamaki et al. | 399/101 X |

FOREIGN PATENT DOCUMENTS

| | | | |
|---|---|---|---|
| JP | 07-287495 | A | 10/1995 |
| JP | 2003-330320 | A | * 11/2003 |
| JP | 2004-125900 | A | 4/2004 |
| JP | 2005-003808 | A | * 1/2005 |
| JP | 2005-234358 | A | 9/2005 |
| JP | 2007-79126 | A | 3/2007 |
| JP | 2010-134359 | A | 6/2010 |

* cited by examiner

*Primary Examiner* — Sophia S Chen

(74) *Attorney, Agent, or Firm* — Canon USA, Inc., IP Division

(57) ABSTRACT

In an image forming apparatus, to provide a lubrication effect for an abutment portion of a transfer belt and a belt cleaning blade, when a control toner image is supplied, the control toner image is supplied to the abutment portion even when it is not necessary, thereby consuming a large amount of toner. In the image forming apparatus, the control unit changes a toner amount of the control toner image reaching the abutment portion of a photosensitive member and a photosensitive member cleaning blade and the toner amount thereof reaching the abutment portion of a transfer belt and a belt cleaning blade, based on a detection result of an environment detection unit.

10 Claims, 4 Drawing Sheets

IMAGE FORMING APPARATUS CAPABLE OF REDUCING A TONER CONSUMPTION AMOUNT BY PERFORMING TONER SUPPLY CONTROL

BACKGROUND OF THE INVENTION

1. Field of the Invention

The present invention relates to an image forming apparatus, which employs an electrophotographic method, such as a laser printer, a copying machine, and a facsimile machine.

2. Description of the Related Art

A color image forming apparatus, in which a plurality of photosensitive drums for forming an image are disposed, forms the image by sequentially transforming toner images formed on the photosensitive drums onto an intermediate transfer belt disposed facing the plurality of photosensitive drums respectively or a transfer member conveyed by a conveyance belt.

Adhering substances such as toner that is not transferred to the transfer member and paper powder may adhere to the intermediate transfer belt or the conveyance belt used in the image forming apparatus described above, and thus a cleaning unit for removing the adhering substances from the belt is provided therein. As the cleaning unit, a method is conventionally known for removing the toner by causing an elastic cleaning blade to contact the belt.

However, in the image forming apparatus that employs the cleaning blade, a friction force is increased at an abutment portion of the cleaning blade and the belt, and thus the adhering substances may not be removed from the belt by the cleaning blade. To solve such a problem, Japanese Patent Application Laid-Open No. 2004-125900 discusses a toner supply control method, in which the toner images are formed on the belt at timings other than image formation, and then the formed toner images are supplied to the abutment portion of the cleaning blade and the belt.

The toner supply control method discussed in Japanese Patent Application Laid-Open No. 2004-125900 periodically supplies the toner to an edge portion of the cleaning blade, so that the friction force generated between the cleaning blade and the intermediate transfer member can be reduced.

However, the timing for performing the toner supply control as discussed in Japanese Patent Application Laid-Open No. 2004-125900 is determined by a printing ratio, with which the toner supply control may be unnecessarily performed to excessively consume the toner.

For example, in an environment of high temperature and high humidity, the friction force generated between the belt and the cleaning blade is hardly increased, and thus even if the toner is not supplied to the abutment portion of the cleaning blade and the belt, the adhering substances may be removed from the belt by the cleaning blade. However, the technique discussed in Japanese Patent Application Laid-Open No. 2004-125900 has a problem in which, since the toner supply control is performed even in the environment of the high temperature and the high humidity with a predetermined timing, the toner is consumed uselessly.

SUMMARY OF THE INVENTION

The present invention is directed to an image forming apparatus capable of reducing a toner consumption amount by toner supply control by performing the toner supply control only in an environment where a cleaning trouble easily occurs.

According to an aspect of the present invention, an image forming apparatus includes an image bearing member on which an electrostatic latent image is formed, a developing unit configured to develop the electrostatic latent image, a first cleaning blade configured to clean a surface of the image bearing member, a transfer belt configured to transfer a toner image onto a recording medium, a second cleaning blade configured to clean a surface of the transfer belt, an environment detection unit configured to detect an environment, and a control unit capable of performing toner supply control for developing a control toner image on the image bearing member by the developing unit at timing other than image formation, wherein the control unit changes an amount of toner, of the control toner image, reaching an abutment portion of the image bearing member and the first cleaning blade and an amount of toner thereof reaching an abutment portion of the transfer belt and the second cleaning blade, based on a detection result by the environment detection unit.

According to a configuration of the present invention, the toner supply control can be performed only in the environment where the cleaning trouble easily occurs, and thus the toner consumption amount by the toner supply control can be reduced.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Dimensions, materials, shapes, and relative arrangement of configuration components described in exemplary embodiments described below can be appropriately changed depending on the configuration of an apparatus to which the present invention is applied and various conditions thereof. Therefore, unless otherwise specifically described, the scope of the present invention is not limited thereto.

Figure 1:
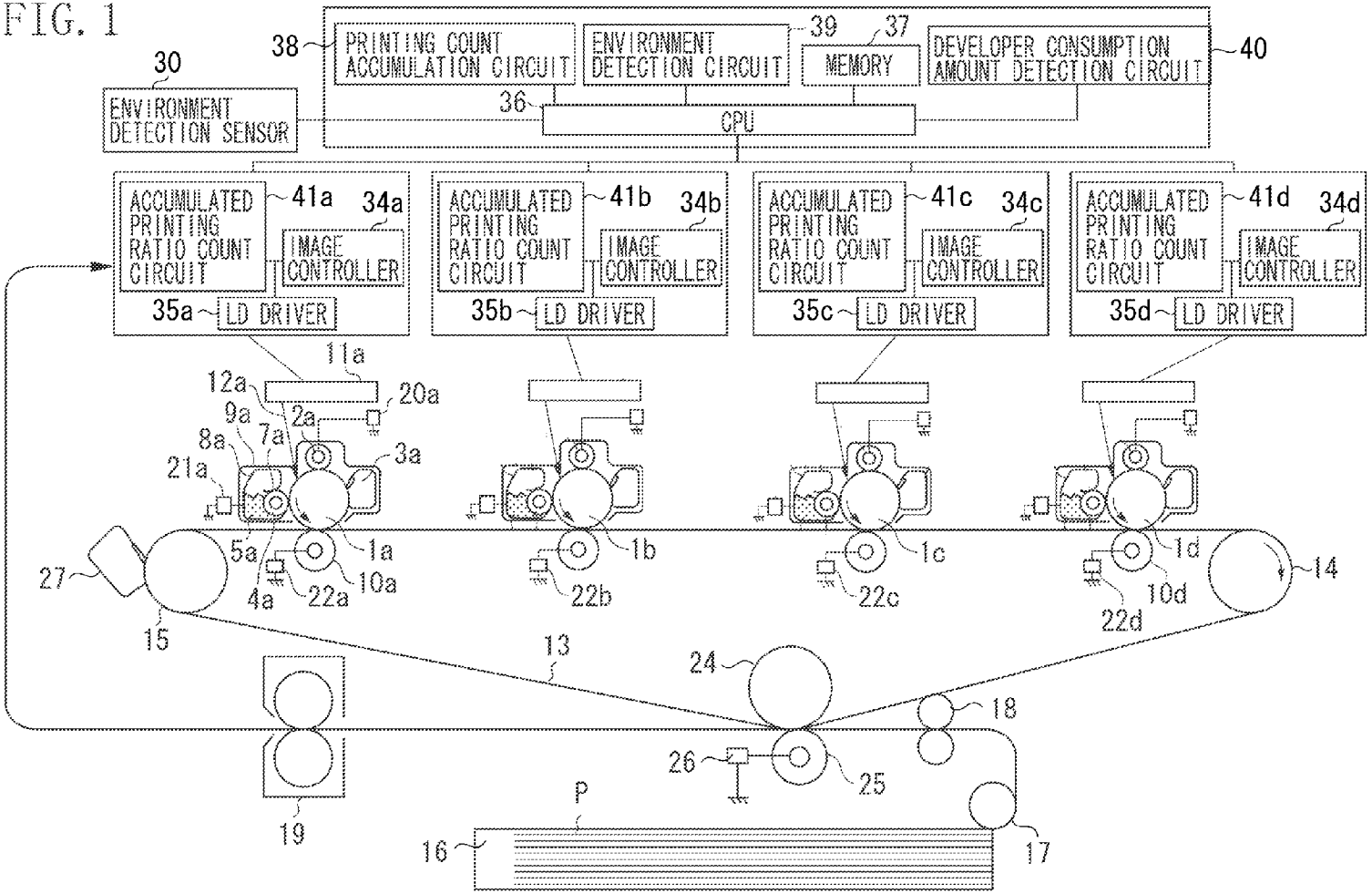
FIG. 1 is a schematic diagram illustrating an overall image forming apparatus according to a first exemplary embodiment.

FIG. 1 illustrates a schematic configuration of a color image forming apparatus employing an intermediate transfer belt, which is a transfer belt, according to the present exemplary embodiment. In the description below, it is defined that a first station prints yellow (Y), a second station prints magenta (M), a third station prints cyan (C), and a fourth station prints black (B). Since each station has the same configuration, the first station is described as a representative.

At the first station, around a photosensitive drum (an image bearing member) 1*a*, a charge roller 2*a* serving as a charging member, a cleaning unit for removing transfer residual toner from the photosensitive drum 1*a*, and a developing unit 8*a* serving as a development device.

The cleaning unit is a first cleaning unit including a photosensitive member cleaning blade (a first cleaning blade) 3*a* and a waste toner box. The photosensitive member cleaning blade 3*a* is an elastic member that abuts on the photosensitive drum 1*a* for cleaning the surface of the photosensitive drum 1*a*.

The developing unit 8*a* includes a development sleeve 4*a*, a toner container 5*a* storing the toner (i.e., developer), and a developer applying blade 7*a*. As a process cartridge 9*a* of an integral type, the photosensitive drum 1*a*, the charge roller 2*a*, the photosensitive member cleaning blade 3*a*, the development sleeve 4*a*, the toner container 5*a*, the developer applying blade 7*a*, and the developing unit 8*a* described above can be attached/detached to/from the image forming apparatus.

An exposure unit 11*a* forms an electrostatic latent image on the photosensitive drum. More specifically, the exposure unit 11*a* includes a scanner unit for scanning laser beam with a multifaceted mirror, and irradiates the photosensitive drum 1*a* with the scanning beam 12*a* modulated based on an image signal.

The photosensitive drum 1*a* is charged uniformly with a negative polarity by a voltage supplied from a power source 20*a* to the charge roller 2*a*. Subsequently, an electrostatic latent image according to image information is formed by scanning beam 12*a* from an exposure unit 11*a*.

The toner in the toner container 5*a* is charged with the negative polarity by the developer applying blade 7*a*, and then applied to the development sleeve 4*a*. When the voltage is supplied from a development voltage power supply 21*a* to the development sleeve 4*a* to rotate the photosensitive drum 1*a*, and then the electrostatic latent image formed on the photosensitive drum 1*a* reaches the development sleeve 4*a*, the electrostatic latent image is visualized with the toner having the negative polarity. On the photosensitive drum 1*a*, a yellow toner image is formed. Since the second to fourth stations have the same configurations as that of the first station, description thereof will not be repeated.

At a position facing each station, an endless intermediate transfer belt 13, which is a transfer belt, is disposed. The intermediate transfer belt 13 is stretched around three rollers including a facing roller 24, a driving roller 14, and a tension roller 15 that are a plurality of stretching rollers, and appropriate tension is maintained. By driving the driving roller 14, the intermediate transfer belt 13 is rotated around.

Further, inside the intermediate transfer belt 13, primary transfer rollers 10*a* to 10*d*, which are primary transfer members, are disposed facing photosensitive drums 1*a* to 1*d*, respectively. The facing roller 24 faces a secondary transfer roller 25, which is a secondary transfer member, via the intermediate transfer belt 13.

The intermediate transfer belt 13 can be abutted/separated on/from each photosensitive drum 1*a* to 1*d* by moving each primary transfer roller. Primary transfer power sources 22*a* to 22*d*, which are voltage supply units, are connected to the primary transfer rollers 10*a* to 10*d*, respectively, and a secondary transfer power source 26 is connected to a secondary transfer roller 25.

The toner images formed on the photosensitive drums 1*a* to 1*d* are primary-transferred onto the intermediate transfer belt 13 when the voltage having an opposite polarity of the toner is applied from the first transfer power sources 22*a* to 22*d* to the first transfer rollers 10*a* to 10*d*, respectively.

Four color toner images superimposed on the intermediate transfer belt 13 are conveyed to a secondary transfer nip portion (abutment portion) formed between the secondary transfer roller 25 and the intermediate transfer belt 13.

A transfer material "P" loaded on a transfer material cassette 16 is picked up by a paper feeding roller 17, and conveyed to a registration roller 18 by a conveyance roller (not illustrated). The transfer material "P" is conveyed by the registration roller 18 to the abutment portion formed by the intermediate transfer belt 13 and the secondary transfer roller 25 in synchronization with the toner images on the intermediate transfer belt 13.

Subsequently, the voltage having the opposite polarity of the toner is applied to the secondary transfer roller 25 by the secondary transfer power supply 26, and a multiple toner image of four colors carried on the intermediate transfer belt 13 is collectively secondary transferred onto the transfer material "P".

The transfer material "P" on which the secondary transfer has been completed is conveyed to a fixing unit 19, and then discharged outside the image forming apparatus as an image formed product after the toner images are fixed. Processing described above is performed during normal image formation.

After the secondary transfer is completed, transfer residual toner and paper powder adhering to the intermediate transfer belt 13 are collected from a surface of the intermediate transfer belt 13 by a belt cleaning unit 27 (second cleaning unit). The belt cleaning unit 27 includes a belt cleaning blade (a second cleaning member) 27*a* that is elastic and formed of urethane rubber. The belt cleaning blade 27*a* abuts on the intermediate transfer belt 13 and cleans the surface thereof.

Figure 2A:
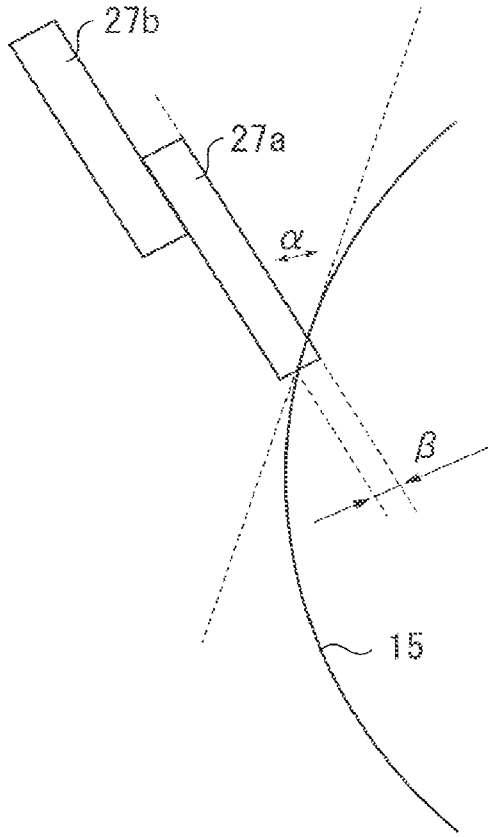
FIGS. 2A and 2B illustrate a belt cleaning blade according to the first exemplary embodiment.

FIG. 2 schematically illustrates a portion of the belt cleaning unit 27, which is in contact with the intermediate transfer belt 13. As illustrated in FIG. 2A, as the cleaning unit 27, the belt cleaning blade 27*a* having the Wallace hardness of 69 degrees that maintains a predetermined intrusion amount at an edge of a metal plate 27*b*, is used.

The Wallace hardness is the hardness measured by using a Wallace hardness scale (model; H12) made by Wallace and Co. Ltd. and indicates a value of an international rubber hardness degree (IRHD). The hardness of the polyurethane rubber used for the belt cleaning blade 27*a* is preferably within a range of 60 to 80 degrees.

The belt cleaning blade 27*a* is fixed so as to satisfy a predetermined setting angle of "$\alpha$"=22 degrees and an intrusion amount "$\beta$"=1.2 mm with respective to the tension roller 15 facing the belt cleaning blade 27*a* via the intermediate transfer belt 13. The setting angle $\alpha$ is defined with a tangent line on the tension roller 15 that is in contact with a cross point of an end surface of the belt cleaning blade 27*a* of the polyurethane rubber and the tension roller 15, when it is supposed that the end portion of the belt cleaning blade 27*a* is not deformed and intrudes into the tension roller 15 as it is.

The angle between the tangent line on the tension roller 15 that is in contact with the cross point and a side surface of the belt cleaning blade 27*a* is the setting angle "$\alpha$". The intrusion amount "$\beta$" represents a distance between the cross point of the end surface of the belt cleaning blade 27*a* and the tension roller 15, and an end portion of the belt cleaning blade 27*a* at a side intruding into the tension roller 15.

The belt cleaning blade 27*a* is stabilized by maintaining a certain abutment pressure to the tension roller 15, and a certain angle between the belt cleaning blade 27*a* and a direction of the tangent line on the abutment portion of the end surface of the belt cleaning blade 27*a* and the intermediate transfer belt 13.

Figure 2B:
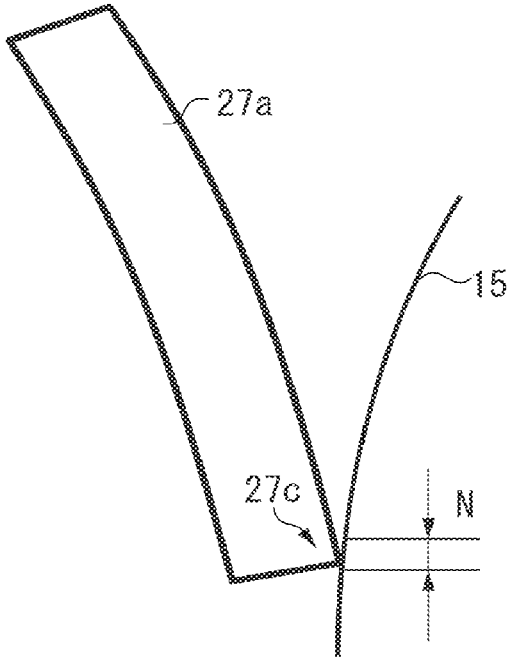

FIG. 2B schematically illustrates a state in which the edge of the cleaning blade abuts on the tension roller 15 in a bending state. The belt cleaning blade 27*a* abuts on the tension roller 15 at the vicinity of an edge end 27*c*. At this portion in a cross-sectional direction of the abutment, a nip "N" is formed.

At this nip "N", the adhering substances adhering to the intermediate transfer belt 13 are cleaned from the intermediate transfer belt 13 by the cleaning blade. Subsequently, by a conveyance unit (not illustrated), the adhering substances are conveyed to an end side in a lateral direction of the cleaning blade and collected into the waste toner box of the belt cleaning unit 27.

As described above, the friction force of the belt cleaning blade 27*a* to the intermediate transfer belt 13 is increased by the belt cleaning blade 27*a* and the intermediate transfer belt 13 sliding with each other. When the friction force is increased, a stick-slip operation occurs, and then a cleaning trouble caused by the stick-slip operation may occur.

Thus, the image forming apparatus can perform toner supply control for periodically supplying a predetermined amount of toner to the abutment portion of the belt cleaning blade 27*a* and the intermediate transfer belt 13.

The toner used as developer includes ester system wax in its core, and adopts styrene-butylacrylate for a resin layer and styrene-polyester for a surface layer. The toner is produced by a suspension polymerization method. Further, titanium oxide having a lubrication effect is added as external additive.

When the toner is supplied to the abutment portion of the belt cleaning blade 27*a* and the intermediate transfer belt 13, powder of titanium oxide added to toner particles perform a polish effect and the lubrication effect on the abutment portion.

Figure 3:
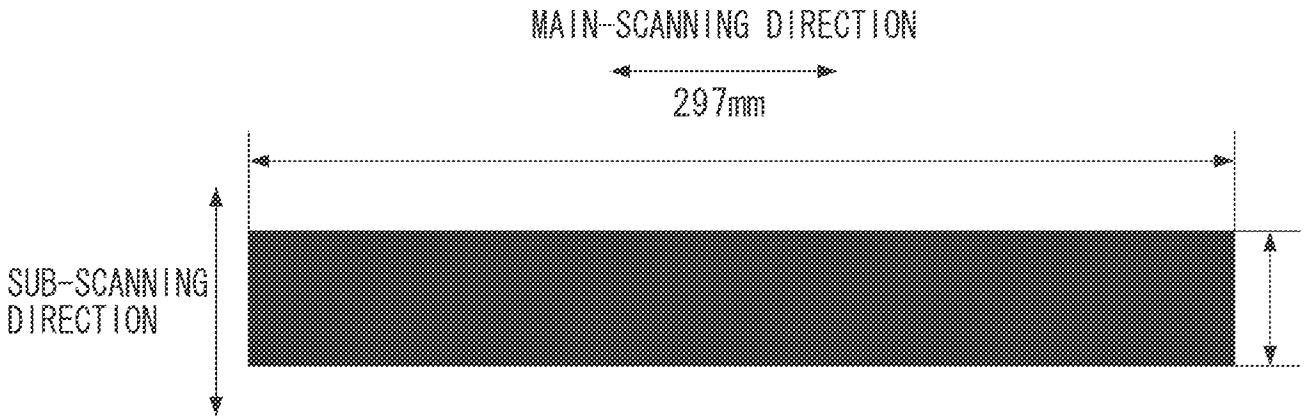
FIG. 3 illustrates toner supply control according to the first exemplary embodiment.

FIG. 3 illustrates a control toner image (i.e., a toner image to be used for controlling) that is formed on the intermediate transfer belt 13 when the toner supply control is performed. The control toner image is a belt-like image of black toner image, as illustrated in FIG. 3.

A method for generating the belt-like image will be described below. By control of a central processing unit (CPU) 36 of a control unit, at timing when the normal image formation is not performed, a controlling image signal (i.e., an image signal to be used for controlling) is transmitted to an image controller 34*d*.

When the controlling image signal is input, an image controller 34*d* drives a laser diode (LD) driver 35*d* to scan the photosensitive drum 1*d* with light emitted by an exposure unit 11*d* for a predetermined time. With this arrangement, a controlling electrostatic latent image is formed on the photosensitive drum 1*d*. The controlling electrostatic latent image is developed by a developing unit and transferred from the photosensitive drum 1*d* onto the intermediate transfer belt 13.

The control toner image transferred onto the intermediate transfer belt 13 has a width of an entire area (297 mm, which is the same as the largest sheet-passing width according to the present exemplary embodiment) in a main scanning direction and a width of 50 mm in a sub-scanning direction.

When this control toner image passes the nip formed of the secondary transfer roller 25 and the intermediate transfer belt 13, the voltage having the opposite polarity of the toner is applied to the secondary transfer roller so that the toner does not adhere onto the secondary transfer roller. Subsequently, the control toner image on the intermediate transfer belt 13 reaches the abutment portion of the intermediate transfer belt 13 and the belt cleaning blade 27*a*.

According to the present exemplary embodiment, similar to the belt-like image of the black toner, using each toner of yellow, magenta, and cyan, the belt-like image can be formed. A similar effect can be obtained from the belt-like image in a single color or the belt-like image in a mixed, plurality of colors.

A timing for performing the toner supply control, which is characteristic of the present exemplary embodiment, will be described. The toner supply control is performed with timing other than the image formation. The timing other than the image formation herein refers to timing before the image formation is started and after the image formation is completed on all transfer materials.

Further, when the image formation is performed on a plurality of transfer materials sequentially conveyed, the timing between the image formation and the subsequent image formation can be the timing other than the image formation. Using an environment detection unit provided in the image forming apparatus according to the present exemplary embodiment, environment detection is performed.

The environment detection unit detects temperature or humidity with an environment sensor 30, which is included in the environment detection unit, and based on its result, weight absolute humidity of the environment in which the apparatus is provided is calculated by an environment detection circuit via the CPU 36. Only when the environment detection unit determines to be a low temperature and low humidity environment based on the calculation result, the toner supply control is performed.

A timing for performing the toner supply control according to the present exemplary embodiment will be described with reference to a flowchart illustrated in FIG. 4. In step S1, the image forming apparatus is turned on, which is a print waiting state. In step S2, a main body of the image forming apparatus receives a print signal from a host computer (not illustrated), and in step S3, the image forming apparatus performs an image forming operation.

In step S4, after the image forming operation is performed, the number of printed sheets is accumulated in the printing count accumulation circuit 38. The printing count accumulation circuit 38 increments a counter each time when printing is performed. Via the CPU 36, the number accumulated by the counter is stored in a memory 37, which is a storage unit, as a value "K" of the accumulated number of sheets.

In step S5, the CPU 36 determines whether the accumulated number "K" of the sheets exceeds a threshold value. According to the present exemplary embodiment, the threshold value is "100". According to the present exemplary embodiment, when the accumulated number "K" of the sheets exceeds the threshold value, it is determined that the toner supply control can be performed. Before the accumulated number "K" of the sheets exceeds the threshold value, even if the toner supply control is not performed, lubricant is sufficiently supplied to the abutment portion.

As a result of the processing performed in step S5, when it is determined that the accumulated number "K" of the sheets exceeds the threshold value (YES in step S5), then in step S6, it is determined whether a value "E" calculated by the environment detection unit in step S6 is smaller than the threshold value.

According to the present exemplary embodiment, the threshold value is defined as 10.00 (g/kg [DA]). When the value "E" is smaller than the threshold value, the toner supply control is performed. In step S6, when it is determined that the value "E" is smaller than the threshold value (YES in step S6), then in step S7, the toner supply control is performed. In step S8, the value "K" of the accumulated number of printed sheets is reset to "0", and in step S9, the printing operation is finished.

As a result of the processing in step S5, when it is determined that the accumulated number "K" of the sheets does not exceed the threshold value (NO in step S5), the toner supply control is not performed, and in step S9, the printing operation is finished. In step S6, when it is determined that the value "E" is not smaller than the threshold value (NO in step S6), then in step S8, the value "K" of the accumulated number of the sheets is reset to "0", and in step S9, the printing operation is finished.

As described above, according to the present exemplary embodiment, when the accumulated number of the printed sheets reaches "100", the toner supply control can be performed. Only when the detection result of the environment detection unit is smaller than the threshold value, the toner supply control is performed. When the weight absolute humidity is the threshold value 10.00 (g/kg [DA]) according to the present exemplary embodiment or less, the environment corresponds to the environment of the low temperature and the low humidity of 15° C. 10% RH.

In such an environment, the hardness of the belt cleaning blade 27*a* becomes harder, which makes the cleaning blade difficult to follow the intermediate transfer belt 13. Further, in the low temperature and low humidity environment, the paper powder is easily generated from recording material, which is the transfer material, and the paper powder adhering to the intermediate transfer belt 13 is increased.

The paper powder adhering to the intermediate transfer belt 13 may be scratched off by the belt cleaning blade 27*a*, however, is likely to stay on the edge end of the blade. In the low temperature and low humidity environment, the hardness of the belt cleaning blade 27*a* is high, and thus the paper powder is likely to stay on the edge end of the blade, thereby easily causing the cleaning trouble.

Figure 4:
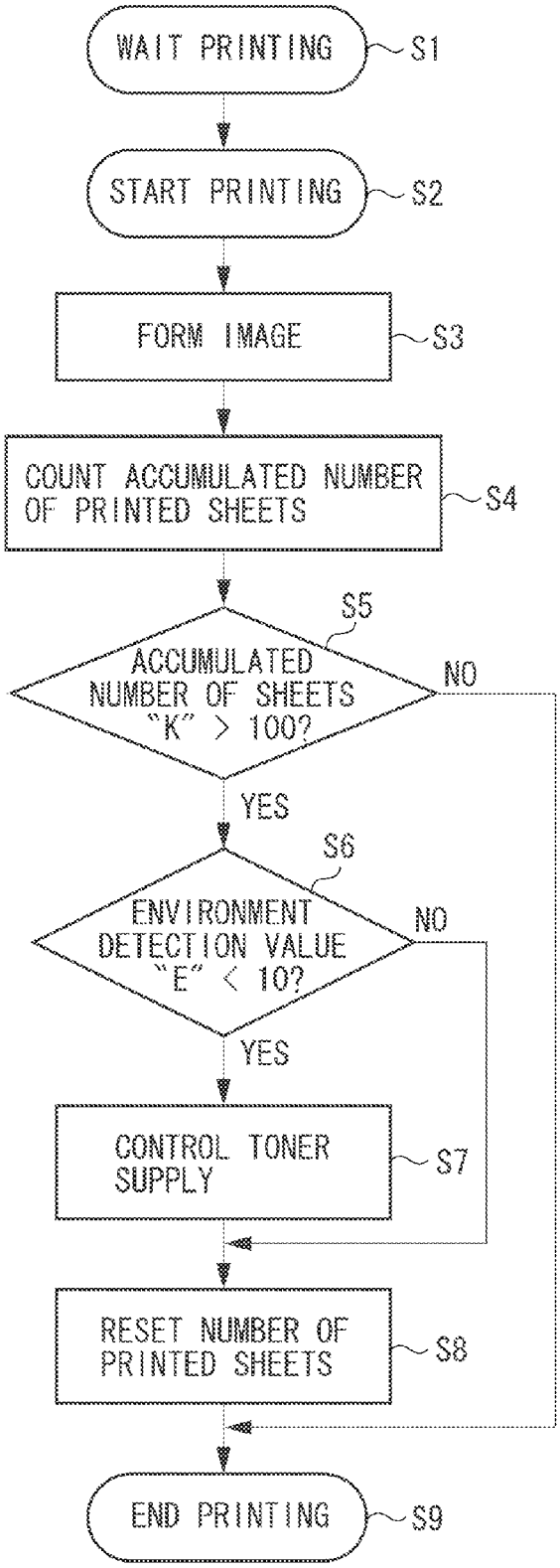
FIG. 4 is a flowchart illustrating the toner supply control according to the first exemplary embodiment.

According to the present exemplary embodiment, the toner supply control is performed only when the conditions of steps S5 and S6 in the flowchart illustrated in FIG. 4 are satisfied. With this arrangement, the cleaning trouble can be prevented with a minimum toner supply amount.

The effect of the present exemplary embodiment will be described with reference to a table 1.

The table 1 indicates the result when the toner supply control is performed with the timing according to the present exemplary embodiment and when the toner supply control is performed with the timing of a first comparison example. The timing of the first comparison example refers to timing when the toner supply control is performed when the condition of step S5 in the flowchart is satisfied, and in other words, when the cumulative number of the printed sheets reaches "100".

As the transfer material, a medium in A4 size is used to which calcium carbonate easily generating the paper powder is added. More specifically, Top Copie made by Neusiedler Inc. having basis weight of 80 g/m$^2$ is used.

The environment of the apparatus when printing is performed is evaluated in the low temperature and low humidity environment of the weight absolute humidity 1.06 at 15° C. 10% relative humidity (RH), a normal temperature and normal humidity environment of the weight absolute humidity 10.64 at 23° C. 60% RH, and a high temperature and high humidity environment of the weight absolute humidity 21.74 at 30° C. 80% RH.

On the transfer material, 1,000 sheets of print patterns of the printing ratio of 5% are printed. The printing ratio herein is defined with a ratio of an area where printing is performed relative to an entire area of the transfer material.

In any environment, the first comparison example performs the toner supply control for each 100 sheets. The toner supply amount used for the toner supply control each time according to the first comparison example is 96 mg, and thus, when printing is performed on 1,000 sheets, the 960-mg toner is consumed for the toner supply control in all environments.

On the other hand, according to the present exemplary embodiment, only in the environment in which the cleaning trouble is likely to occur, the toner supply control is performed. Therefore, the number of times for performing the toner supply control can be reduced. In the normal temperature and normal humidity environment or the high temperature and high humidity environment, the 960-mg supply control toner for 1,000 sheets can be reduced. The toner amount necessary for printing one sheet in A4 size on which printing

TABLE 1

| ENVIRONMENT | TEMPERATURE (° C.) | HUMIDITY (RH) | WEIGHT ABSOLUTE HUMIDITY (DA) g/kg | NUMBER OF PRINTED SHEETS | AVERAGE PRINTING RATIO |
|---|---|---|---|---|---|
| LOW TEMPERATURE LOW HUMIDITY | 15 | 10 | 1.06 | 1000 | 5% |
| NORMAL TEMPERATURE NORMAL HUMIDITY | 23 | 60 | 10.64 | 1000 | 5% |
| HIGH TEMPERATURE HIGH HUMIDITY | 30 | 60 | 21.74 | 1000 | 5% |

| | 1ST COMPARISON EXAMPLE | | 1ST EXEMPLARY EMBODIMENT | | REDUCED AMOUNT OF |
|---|---|---|---|---|---|
| ENVIRONMENT | NUMBER OF TIMES OF SUPPLY CONTROL | TONER AMOUNT (mg) FOR SUPPLY CONTROL | NUMBER OF TIMES OF SUPPLY CONTROL | TONER AMOUNT (mg) FOR SUPPLY CONTROL | TONER (mg) ACCORDING TO 1ST EXEMPLARY EMBODIMENT |
| LOW TEMPERATURE LOW HUMIDITY | 10 | 960 | 10 | 960 | 0 |
| NORMAL TEMPERATURE NORMAL HUMIDITY | 10 | 960 | 0 | 0 | 960 |
| HIGH TEMPERATURE HIGH HUMIDITY | 10 | 960 | 0 | 0 | 960 |

is to be performed at the printing ratio of 5% is approximately 63 mg. Therefore, the toner for about 15 sheets can be reduced.

As described above, according to the present exemplary embodiment, the number of times for performing the toner supply control can be controlled and the toner consumption can be reduced.

Further, the configuration according to the present exemplary embodiment can also be applied to the image forming apparatus including a conveyance belt for conveying the transfer material not the intermediate transfer belt as a transfer belt.

Further, a method may be applied other than the method for detecting the low temperature and low humidity environment by calculating the weight absolute humidity based on the detection result by the environment sensor 30. When the temperature is detected and then the temperature is a predetermined temperature or lower, it is determined to be the low temperature and low humidity environment. In place of the temperature, relative humidity and an absolute moisture amount may be detected.

In step S5, the CPU 36 determines whether the accumulated number of sheets K exceeds the threshold. However, a developer consumption amount may be used as a threshold. The developer consumption amount can be detected by a developer consumption amount detection circuit 40. Hereinbelow, a specific calculation method will be described.

Image controllers 34*a* to 34*d* for respective color stations perform signal processing for forming latent images and transmit the processed signals to LD drivers 35*a* to 35*d*, respectively. Each of the LD drivers 35*a* to 35*d* converts an electric signal into an optical signal, and turns on a laser diode (LD). Accumulated printing ratio count circuits 41*a* to 41*d* respectively calculate printing ratios of respective colors based on time periods for turning on the laser diodes (LD) by the image controllers 34*a* to 34*d* for respective colors.

The developer consumption amount detection circuit 40 collects, via the CPU 36, the calculation results of the calculated printing ratios of respective colors and the value of the accumulated print counts accumulated by the respective accumulated printing ratio count circuits 41*a* to 41*d*. The CPU 36 may determine that the average printing ratio exceeds the threshold when the average printing ratio calculated by the developer consumption amount detection circuit 40 is smaller than 5%.

According to the present exemplary embodiment, when the toner supply control is performed, control toner can be also supplied to the abutment portion of the photosensitive member and the photosensitive member cleaning blade 3*a*. According to the present exemplary embodiment, the control toner image developed on the photosensitive drum 1*a* while the toner supply control is performed and the toner amount to be supplied to the abutment portion of two cleaning blades are changed depending on the environment.

More specifically, when the detection result by the environment detection unit is the low temperature and low humidity environment, the toner amount to be supplied to the abutment portion of the intermediate transfer belt 13 and the belt cleaning blade 27*a* in the control toner image is larger than that when the detection result by the environment detection unit is the high temperature and high humidity environment. The same configurations in the image forming apparatus as those described in the first exemplary embodiment will not be repeatedly described.

The belt cleaning blade and the photosensitive member cleaning blade 3*a* need different amount of toner depending on the environment. The photosensitive member cleaning blade 3*a* abutting on the photosensitive drum 1*a* needs more toner in the high temperature and high humidity environment than that in the low temperature and low humidity environment.

That is to prevent a cleaner blade in a plate-like shape that has become easily deformed due to its rubber softened by the high temperature and the high humidity from being turned over by the rigid photosensitive drum 1*a*. In the environment of the high temperature, the rubber of the cleaning blade becomes soft, and thus the rubber is easily deformed. Further, in the environment of the high humidity, since much moisture stays at a portion where the cleaning blade and the photosensitive drum are in contact with each other, the slidability thereof becomes low.

However, in the low temperature and low humidity environment, an amount of the paper powder adhering to the intermediate transfer belt 13 is increased, and thus the cleaning trouble is likely to occur more often at the abutment portion of the belt cleaning blade and the intermediate transfer belt 13 than at the abutment portion of the photosensitive member cleaning blade 3*a* and the photosensitive member.

Therefore, in the low temperature and low humidity environment, the control toner can be supplied to the abutment portion of the belt cleaning blade and the intermediate transfer belt 13, in priority to addressing the cleaning trouble at the abutment portion of the belt cleaning blade and the intermediate transfer belt 13.

A specific method for separating the control toner images will be described below. According to the present exemplary embodiment, in the above-described configuration of the first exemplary embodiment, the value "E" of the weight absolute humidity is acquired, and when the value is smaller than the threshold value 10.00 (g/kg[DA]), it is determined to be the low temperature and low humidity environment.

When it is determined to be the low temperature and low humidity environment, a part of the control toner image developed on the photosensitive drum is transferred onto the intermediate transfer belt 13. For this reason, when the control toner is transferred onto the intermediate transfer belt 13, the voltage to be applied to the first transfer member is set to 0V.

With this arrangement, half of the toner, of the control toner formed on the photosensitive drum, is moved onto the intermediate transfer belt 13 and another half of the control toner is left on the photosensitive drum 1*a*. On the other hand, when it is not the low temperature and low humidity environment, the intermediate transfer belt 13 is separated from the photosensitive drum 1*a* so that the whole control toner image formed on the photosensitive drum is left on the photosensitive drum.

Effects of the present exemplary embodiment will be described with reference to a table 2 illustrated below.

TABLE 2

| ENVIRONMENT | TEMPERATURE (° C.) | HUMIDITY (RH) | WEIGHT ABSOLUTE HUMIDITY (DA) g/kg | NUMBER OF PRINTED SHEETS | AVERAGE PRINTING RATIO | 2ND COMPARISON EXAMPLE: NUMBER OF TIMES OF SUPPLY CONTROL | 2ND COMPARISON EXAMPLE: RATIO OF TONER AMOUNT TO BE MOVED TO INTERMEDIATE TRANSFER MEMBER | 2ND COMPARISON EXAMPLE: TONER AMOUNT (mg) FOR SUPPLY CONTROL IN DEVELOPING UNIT ADJUSTMENT MODE |
|---|---|---|---|---|---|---|---|---|
| LOW TEMPERATURE LOW HUMIDITY | 15 | 10 | 1.06 | 1000 | 5% | 20 | 0.5 | 1920 |
| NORMAL TEMPERATURE NORMAL HUMIDITY | 23 | 60 | 10.64 | 1000 | 5% | 20 | 0.5 | 1920 |
| HIGH TEMPERATURE HIGH HUMIDITY | 30 | 80 | 21.74 | 1000 | 5% | 20 | 0.5 | 1920 |

| ENVIRONMENT | 2ND EXEMPLARY EMBODIMENT: NUMBER OF TIMES OF SUPPLY CONTROL | 2ND EXEMPLARY EMBODIMENT: RATIO OF TONER AMOUNT TO BE MOVED TO INTERMEDIATE TRANSFER MEMBER | 2ND EXEMPLARY EMBODIMENT: TONER AMOUNT (mg) FOR SUPPLY CONTROL | REDUCED AMOUNT (mg) OF TONER ACCORDING TO 2ND EXEMPLARY EMBODIMENT |
|---|---|---|---|---|
| LOW TEMPERATURE LOW HUMIDITY | 10 | 0.5 | 960 | 960 |
| NORMAL TEMPERATURE NORMAL HUMIDITY | 10 | 0 | 960 | 960 |
| HIGH TEMPERATURE HIGH HUMIDITY | 10 | 0 | 960 | 960 |

The table 2 indicates a result in which printing is performed by the configuration of the present exemplary embodiment for changing the ratio of the tonner amount to be supplied to a photosensitive drum side and the intermediate transfer member and the configuration of a second comparison example not for changing the ratio of the toner amount to be supplied to the photosensitive drum side and the intermediate transfer member, according to the environment.

As the transfer material, a medium in A4 size is used to which calcium carbonate easily generating the paper powder is added. More specifically, Top Copie made by Neusiedler Inc. having basis weight of 80 g/m$^2$ is used.

The environment of the apparatus when printing is performed is evaluated in the low temperature and low humidity environment of the weight absolute humidity 1.06 at 15° C. and 10% RH, the normal temperature and normal humidity environment of the weight absolute humidity 10.64 at 23° C. 60% RH, and the high temperature and high humidity environment of the weight absolute humidity 21.74 at 30° C. 80% RH.

On the transfer material, 1,000 sheets of print patterns of the printing ratio of 5% are printed. The printing ratio is defined with the ratio of the area where printing is performed relative to the entire area of the transfer material.

According to the second comparison example, the toner amount of the control toner image to be moved from the photosensitive drum to the intermediate transfer belt 13 is equal (at the ratio of 0.5) to the toner amount to be left on the photosensitive drum without being transferred onto the intermediate transfer belt 13, and the ratio is not changed depending on the environment.

Therefore, the toner supply control needs to be performed every 50 sheets so that cleaning effectiveness of the intermediate transfer member can be maintained in the low temperature and low humidity environment, and the cleaning blade for a photosensitive drum is not turned over in the high temperature and high humidity environment. The toner amount used for the toner supply control each time according to the second comparison example is 96 mg, and thus, when printing is performed on 1,000 sheets, the 1,920-mg toner is consumed for the toner supply control in all environments.

According to the present exemplary embodiment, in the low temperature and low humidity environment, the toner amount of the control toner image to be moved from the photosensitive drum to the intermediate transfer belt 13 is substantially equal to the toner amount to be left on the photosensitive drum without being moved onto the intermediate transfer belt 13.

In the normal temperature and normal humidity environment and the high temperature and high humidity environment, the whole control toner is left on the photosensitive drum. As a result, frequency of the toner supply control can be halved to every 100 sheets of the second comparison example.

The toner amount used for the toner supply control each time according to the present exemplary embodiment is 96 mg, and thus, when printing is performed on 1,000 sheets, the 960-mg toner is consumed for the toner supply control in all environments.

Therefore, even if the tonner supply control is performed at half frequency of the second comparison example, the cleaning blade of the photosensitive drum can be prevented from being turned over in the high temperature and high humidity environment, and also the cleaning trouble will be hardly caused in the low temperature and low humidity environment.

With the arrangements described above, in all environments including the low temperature and low humidity environment, the normal temperature and normal humidity environment, and the high temperature and high humidity environment, the 960-mg supply control toner for every 1,000 sheets can be reduced.

According to the description above, in the environment other than the low temperature and low humidity, the control toner image reaches the abutment portion on the photosensitive member cleaning blade 3*a*, however, a part of the control toner image may be supplied to the abutment portion on the belt cleaning blade. In such a case, in a state where the photosensitive drum and the intermediate transfer belt 13 abut on each other, the voltage to be supplied to the primary transfer member may be appropriately set.

Further, the control toner image may be used as the tonner to be moved onto the photosensitive drum 1*a* in a development adjusting mode, which has been conventionally known. The development adjusting mode refers to control for maintaining uniformity of a state of the toner in the developing unit by periodically developing the toner in the developing unit to the photosensitive drum 1*a* to forcibly move the toner thereto. The development adjusting mode to be periodically performed is applied as the tonner supply control, and the tonner forcibly moved to the photosensitive drum 1*a* is separated depending on the environment so that the toner consumption amount can be further reduced.

As described above, according to the present exemplary embodiment, when the toner supply control is performed, the abutment portion to which the toner is supplied is changed to reduce the toner consumption.

Further, the configuration according to the present exemplary embodiment can also be adopted to the image forming apparatus including the conveyance belt for conveying the transfer material not the intermediate transfer belt as the transfer belt.

As described above, the exemplary embodiments of the present invention have been described. The present invention is not limited to the above-described exemplary embodiments, and various modifications may be made without departing from the spirit or scope of the general inventive concept of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-101429 filed Apr. 28, 2011, which is hereby incorporated by reference herein in its entirety.

What is claimed is:

1. An image forming apparatus comprising:

an image bearing member on which an electrostatic latent image is formed;

a developing unit configured to develop the electrostatic latent image;

a first cleaning blade configured to clean a surface of the image bearing member;

a transfer belt configured to transfer a toner image onto a recording medium;

a second cleaning blade configured to abut on the transfer belt and clean a surface of the transfer belt;

an environment detection unit configured to detect an environment; and a control unit capable of performing toner supply control for developing a control toner image on the image bearing member by the developing unit at timing other than image formation, wherein, only when the environment detection unit detects a value equal to or smaller than a predetermined threshold value, the control unit supplies the control toner image to an abutment portion on the second cleaning blade.

2. The image forming apparatus according to claim 1, wherein, when the environment detection unit detects the value equal to or smaller than the predetermined threshold value, the environment detection unit determines that an environment is a low temperature and low humidity environment.

3. The image forming apparatus according to claim 1, wherein the control toner image has a full size in a lateral direction orthogonal to a moving direction of the image bearing member.

4. The image forming apparatus according to claim 1, wherein the transfer belt is an intermediate transfer belt on which a toner image is transferred from the image bearing member.

5. The image forming apparatus according to claim 1, wherein the transfer belt is a conveyance belt that conveys a recording medium onto which the toner image is transferred from the image bearing member.

6. An image forming apparatus comprising:

an image bearing member on which an electrostatic latent image is formed;

a developing unit configured to develop the electrostatic latent image;

a first cleaning blade configured to clean a surface of the image bearing member;

a transfer belt configured to transfer a toner image onto a recording medium;

a second cleaning blade configured to abut on the transfer belt and clean a surface of the transfer belt;

an environment detection unit configured to detect an environment; and a control unit capable of performing toner supply control for developing a control toner image on the image bearing member by the developing unit at timing other than image formation, wherein, when the environment detection unit detects a value larger than a predetermined threshold value, the control unit increases an amount of the toner reaching the abutment portion on the first cleaning blade more than the amount of the toner reaching the abutment portion on the second cleaning blade.

7. The image forming apparatus according to claim 6, wherein, when the environment detection unit detects the value equal to or smaller than the predetermined threshold value, the environment detection unit determines that an environment is a low humidity environment.

8. The image forming apparatus according to claim 6, wherein, when the environment detection unit detects the value equal to or smaller than the predetermined threshold value, the environment detection unit determines that an environment is a low temperature environment.

9. An image forming apparatus comprising:

an image bearing member on which an electrostatic latent image is formed;

a developing unit configured to develop the electrostatic latent image;

a first cleaning blade configured to clean a surface of the image bearing member;

a transfer belt configured to transfer a toner image onto a recording medium;

a second cleaning blade configured to abut on the transfer belt and clean a surface of the transfer belt;

an environment detection unit configured to detect an environment; and a control unit capable of performing toner supply control for developing a control toner image on the image bearing member by the developing unit at timing other than image formation, wherein, when the environment detection unit detects a value smaller than a predetermined threshold value, the control unit causes an amount of the toner reaching the abutment portion on the first cleaning blade to be equal to the amount of the toner reaching the abutment portion on the second cleaning blade.

10. The image forming apparatus according to claim 9, further comprising:

a transfer unit facing an image carrying member via the transfer belt; and a power supply configured to apply voltage to the transfer unit, wherein, when the environment detection unit detects the value smaller than the predetermined threshold value, the power supply does not apply the voltage to the transfer unit.

* * * * *